United States Patent [19]

Galoob

[11] 4,420,095

[45] Dec. 13, 1983

[54] MINIATURE GUM MACHINE

[76] Inventor: David Galoob, 90 Beachmont Dr., San Francisco, Calif. 94132

[21] Appl. No.: 324,068

[22] Filed: Nov. 23, 1981

[51] Int. Cl.[3] ..... B65G 59/00

[52] U.S. Cl. ..... 221/265; 194/93

[58] Field of Search ..... 221/263, 264, 265, 266; 194/63, 61, 54, 93, 92

[56] References Cited

U.S. PATENT DOCUMENTS

| | | | |
|---|---|---|---|
| 1,981,931 | 11/1934 | Vogel et al. | 221/265 |
| 2,694,480 | 11/1954 | Mason | 221/265 |
| 3,885,703 | 5/1975 | Neavin | 221/265 |

*Primary Examiner*—Joseph J. Rolla
*Assistant Examiner*—Kenneth Noland
*Attorney, Agent, or Firm*—Daniel Jay Tick

[57] ABSTRACT

A miniature item machine has a base member having a bottom, a top spaced therefrom and a chute formed therein and extending from the top to the bottom thereof. A base housing member is fitted on the base member and has a top part spaced from the top of the base member. The top part has an opening formed therein partially extending over the chute and a dispenser housing extending upward therefrom around part of the opening. A dispenser device is rotatably mounted in the dispenser housing of the base housing member on the top of the base member and has an arm extending from the base housing member for selectively manually rotating the dispenser device. A storage receptacle of sleeve-like configuration has an open top and a spaced open bottom affixed to the top part of the base housing member for storing miniature items. A predetermined number of the items are selectively dispensed from the storage receptacle to the chute and then out of the chute by manual rotation of the dispenser device. A cover removably mounted on the top of the storage receptacle provides access to the receptacle.

9 Claims, 19 Drawing Figures

FIG. 5
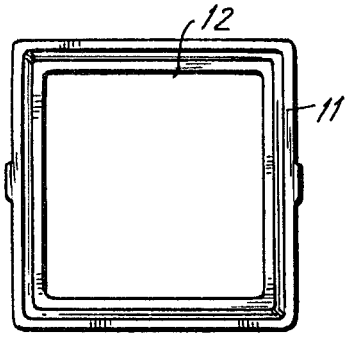
FIG. 7
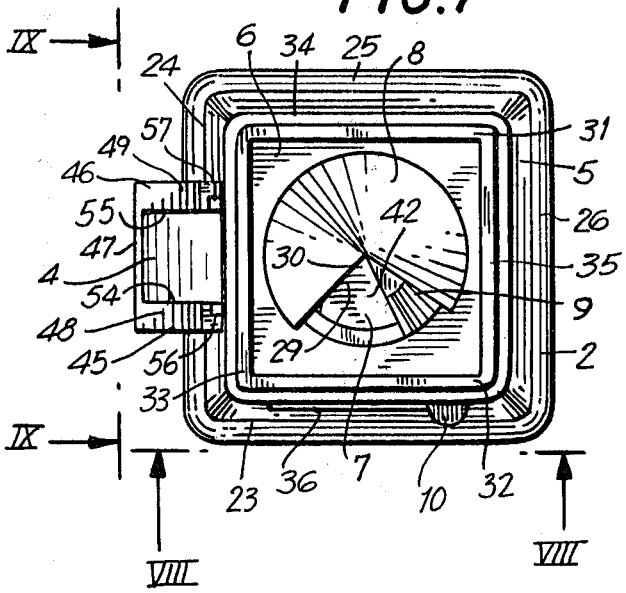
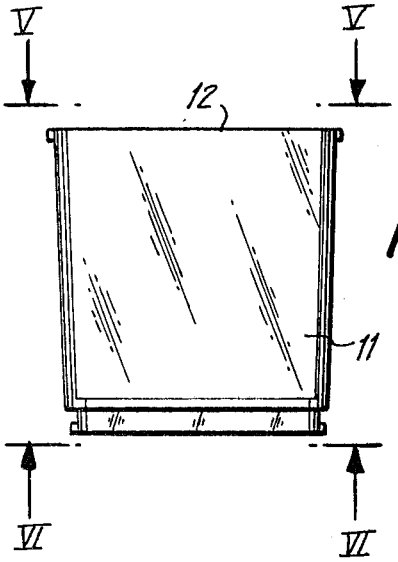
FIG. 4
FIG. 6
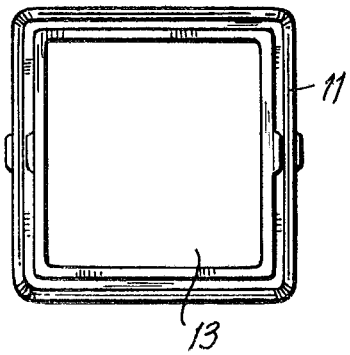
FIG. 8
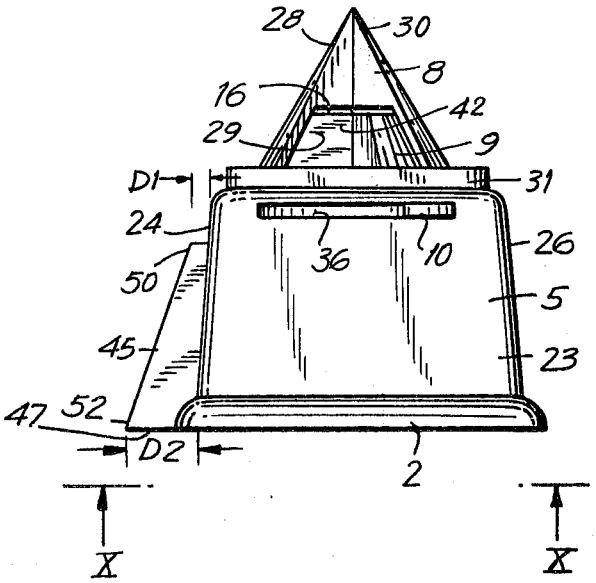

FIG. 9
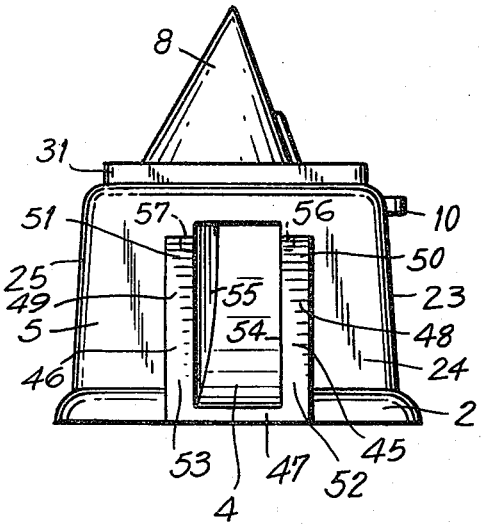
FIG. 10
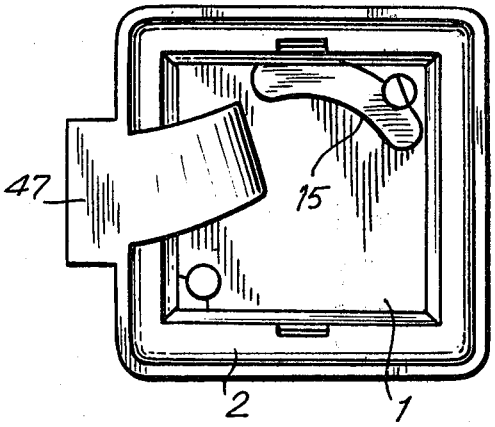
FIG. 11
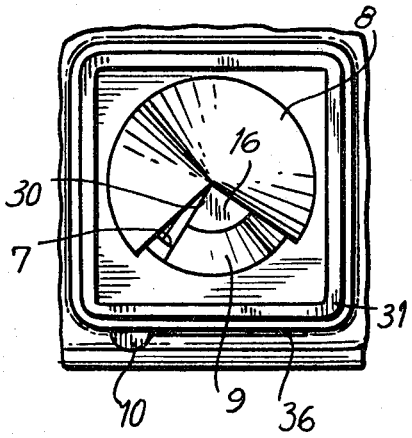
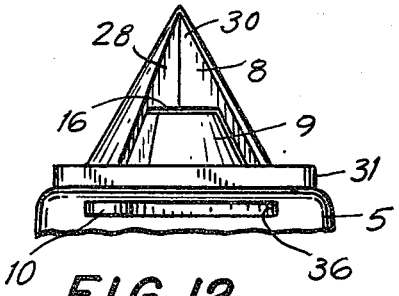
FIG. 12
FIG. 13
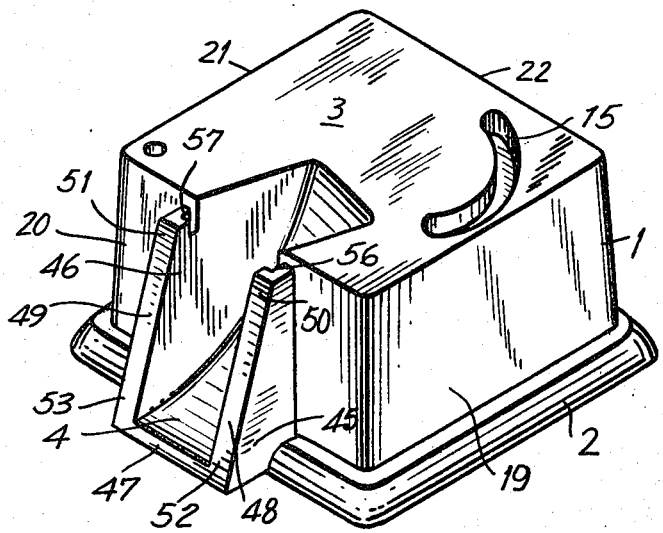

MINIATURE GUM MACHINE

BACKGROUND OF THE INVENTION

The present invention relates to a miniature gum machine. More particularly, the invention relates to a toy device of small dimensions for dispensing miniature pieces of chewing gum.

Gum or gumball machines have been popular for many years and are especially popular with children. Small children find it difficult, if not impossible, to operate full-sized gum or gumball machines. This leads to unhappiness and frustration of the child and annoyance to an accompanying parent or adult.

Yound children relate to small-dimensioned playthings such as, for example, miniature cars, trucks, boats, airplanes, and the like, since these items are easy for them to handle and play with.

The principal object of the invention is to provide a miniature gum machine.

An object of the invention is to provide a miniature gum machine of simple structure, which is manually controlled with facility, convenience and ease by small children to selectively dispense miniature pieces of chewing gum.

Another object of the invention is to provide a miniature gum machine of simple structure, which is inexpensive in manufacture and amuses and delights small children by selectively dispensing miniature pieces of chewing gum under their control.

Still another object of the invention is to provide a miniature gum machine which is operated with facility, convenience and ease by anyone, including very young children, and functions efficiently, effectively and reliably to dispense miniature pieces of chewing gum, as desired.

BRIEF SUMMARY OF THE INVENTION

In accordance with the invention, a miniature item machine comprises a base member having a bottom, a top spaced therefrom and a chute formed therein and extending from the top to the bottom thereof. A base housing member is fitted on the base member and has a top part spaced from the top of the base member. The top part has an opening formed therein partially extending over the chute and a dispenser housing extending upward therefrom around part of the opening. A dispenser device is rotatably mounted in the dispenser housing of the base housing member on the top of the base member and has an arm extending from the base housing member for selectively manually rotating the dispenser device. A storage receptacle of substantially sleeve-like configuration has an open top and a spaced open bottom affixed to the top part of the base housing member for storing miniature items, whereby a predetermined number of the items are selectively dispensed from the storage receptacle to the chute and thence out of the chute by manual rotation of the dispenser device. A cover is removably mounted on the top of the storage receptacle for providing access to the receptacle.

The items are miniature pieces of chewing gum.

The base member has a guide slot formed in the top thereof in spaced relation with the chute. The dispenser device has a top and a spaced bottom with a guide pin extending downward therefrom and slidably accommodated in the guide slot.

The base member has a plurality of sides extending between the top and bottom thereof substantially perpendicularly thereto. The base housing member has a plurality of sides juxtaposed with the sides of the base member. The dispenser housing is of substantially conical configuration having an axis, a solid apex portion and a hollow base portion whereby the base portion next-adjacent the top of the base member is of substantially frusto-conical configuration.

The dispenser housing has a notch formed therein extending substantially from the axis thereof in the solid apex portion thereof. The notch is of substantially V cross-section with the vertex of the notch substantially coincident with the axis of the dispenser housing.

The base housing member has a ledge extending substantially perpendicularly from the top part thereof and having a plurality of sides corresponding to and spaced from the sides of the base housing member. The bottom of the storage receptacle is juxtaposed with and affixed to the ledge.

One of the sides of the base housing member has a slot formed therethrough in proximity with and substantially parallel to the top part thereof and another of the sides of the base housing member has an opening therein extending from the bottom part thereof, and said arm of said dispenser device extends through the slot to facilitate manual movement thereof.

The dispenser device is of substantially frusto-conical configuration and is rotatably housed in the hollow base portion of the dispenser housing of the base housing member. The dispenser device has an axis, a major base circumference, a flange extending substantially radially from the major base circumference and a notch formed therein extending substantially from the axis thereof. The notch is of substantially V cross-section with the vertex of the notch substantially coincident with the axis of the dispenser device. The arm of the dispenser device extends substantially radially from and substantially coplanarly with the flange. When the dispenser device is in a first position, the notches of the dispenser device and the dispenser housing are substantially in alignment, so that the miniature items are collected in the notch of the dispenser device and supported by the top of the base member in spaced relation with the chute. When the dispenser device is manually rotated, via the arm thereof, to a second position, the notches of the dispenser device and the dispenser housing are moved out of alignment and the notch of the dispenser device is in alignment with the chute, so that the miniature items collected in the notch of the dispenser device are moved by the dispenser device to the chute and deposited in the chute whence the items move down and out of the chute.

The chute of the base member opens in one of the sides thereof from the top to the bottom thereof and in the top thereof at the one of the sides. The base member has a pair of spaced substantially parallel walls extending from the one of the sides thereof substantially perpendicularly to the one of the sides at the sides of the chute and extending through the opening of the other of the sides of the base housing member and a lip extending substantially coplanarly with the bottom of the base member and beyond the one of the sides. The walls join the lip at spaced opposite sides of the lip.

The walls have coplanar edges spaced from the one of the sides of the base member and the edges have tops spaced a predetermined distance from the one of the sides and bottoms spaced a distance from the one of the sides greater than the predetermined distance.

The walls have inside surfaces facing each other with a notch formed in each of the inside surfaces at the top thereof. A chute flap has spaced opposite sides and a pair of pins extending from the sides and pivotally accommodated in the notches. The chute flap hangs over the chute in the one of the sides and is pivotally moved to open the chute by miniature items sliding out of the chute.

A spring biasing member is provided between the top part of the base housing member and the top of the base housing. The spring biasing member is coupled to the dispenser device and urges the dispenser device to the first position thereof.

BRIEF DESCRIPTION OF THE DRAWINGS

In order that the invention may be readily carried into effect, it will now be described with reference to the accompanying drawings, wherein:

FIG. 4 is a side view of the storage receptacle of the embodiment of FIG. 1;

FIG. 5 is a view, taken along the lines V—V, of FIG. 4;

FIG. 6 is a view, taken along the lines VI—VI, of FIG. 4;

FIG. 7 is a top view of the combined base member and base housing member of the embodiment of FIG. 1;

FIG. 8 is a view, taken along the lines VIII—VIII, of FIG. 7:

FIG. 9 is a view, taken along the lines IX—IX, of FIG. 7;

FIG. 10 is a view, taken along the lines X—X, of FIG. 8;

FIG. 11 is a top view of the dispenser housing and dispenser device of the embodiment of FIG. 1, with the dispenser device in its position opposite that of FIG. 7;

FIG. 12 is a side view of the dispenser housing, dispenser device and part of the base housing member of the embodiment of FIG. 1, with the dispenser device in its position opposite that of FIG. 8;

FIG. 13 is a perspective view of the base member of the embodiment of FIG. 1;

DETAILED DESCRIPTION OF A PREFERRED EMBODIMENT OF THE INVENTION

Figure 1:
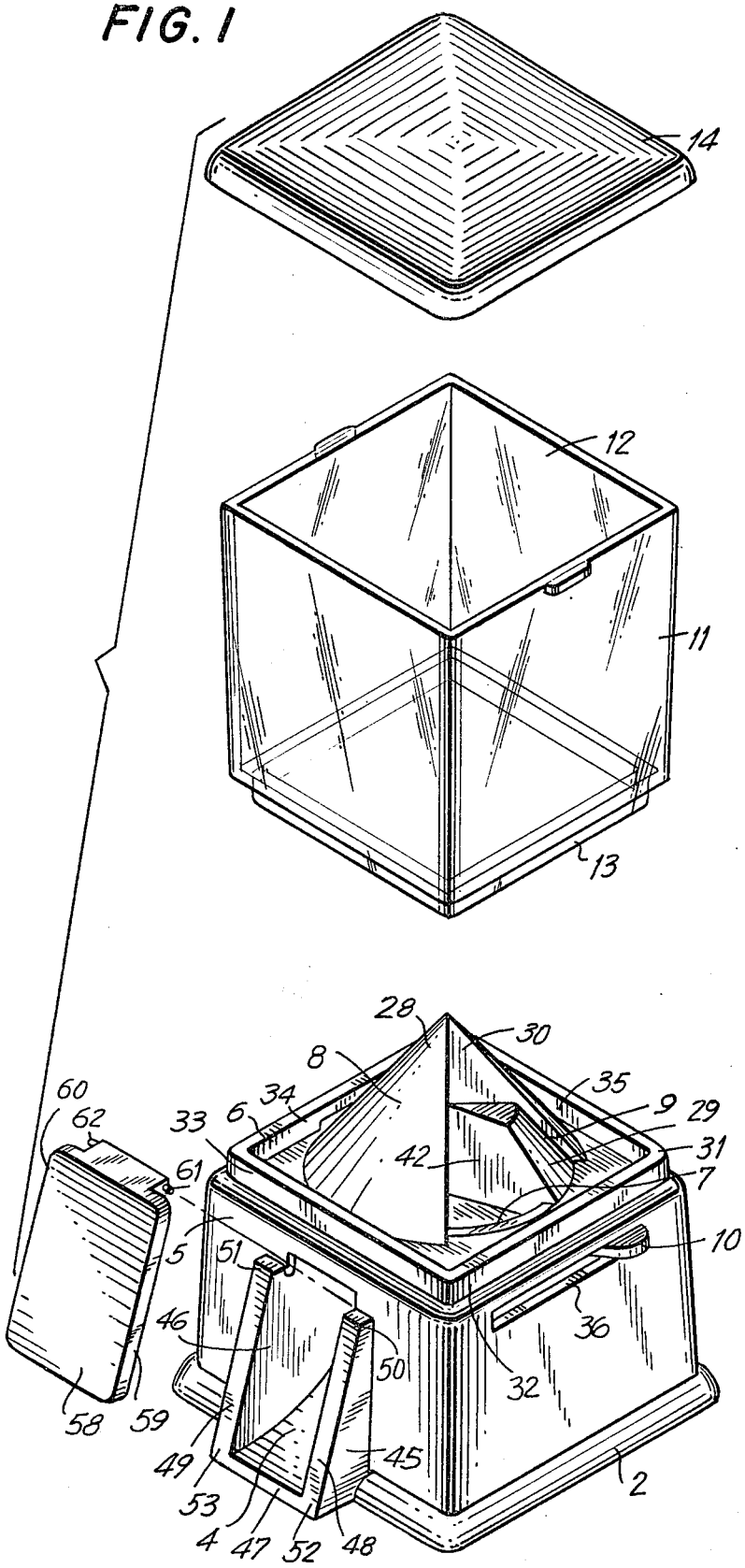
FIG. 1 is an exploded perspective view of an embodiment of the miniature gum machine of the invention.

The miniature gum machine of the invention dispenses any miniature items and is not limited to dispensing chewing gum.

The machine comprises a base member 1 (FIGS. 10, 13, 15 and 16) having a bottom 2 (FIGS. 1, 7, 8, 9, 10, 13, 15 and 16) and a top 3 (FIGS. 13, 15 and 16) spaced from said bottom. The base member 1 has a chute 4 formed therein, as shown in FIGS. 1, 7, 9, 13, 15 and 16, and extending from the top 3 to the bottom 2 of said base member.

A base housing member 5 (FIGS. 1, 7, 8, 9, 12, and 14) is fitted on the base member 1 and has a top part 6 (FIGS. 1, 7 and 14) spaced from the top 3 of the base member 1. The top part 6 of the base housing member 5 has a circular opening 7 formed therein (FIGS. 1, 7 and 11) partially extending over the chute 4, as is evident from FIGS. 1 and 7. The base housing member 5 also has a dispenser housing 8 (FIGS. 1, 7, 8, 9, 11, 12 and 14) extending upward from the top part 6 of said base housing member around part of the opening 7, as shown in FIGS. 1, 7 and 11.

A dispenser device 9 (FIGS. 1, 7, 8, 11, 12, 15, 16, 17 and 18) is rotatably mounted in the dispenser housing 8 of the base housing member 5 on the top 3 of the base member 1, as is evident from FIGS. 1, 7, 8, 12, 15 and 16. The dispenser device 9 has an arm 10 (FIGS. 1, 7, 8, 9, 11, 12, 15, 16, 17 and 18) extending from the base housing member 5 for selectively manually rotating the dispenser device.

A storage receptacle 11 (FIGS. 1, 4, 5 and 6) is of substantially sleeve-like configuration and has an open top 12 (FIGS. 1, 4 and 5) and a spaced open bottom 13 (FIGS. 1, 4 and 6). The storage receptacle 11 is affixed to the top part 6 of the base housing member 5 at its bottom 13. The storage receptacle 11 stores miniature items of any desired type such as, for example, miniature candies and miniature pieces of chewing gum. In a preferred embodiment of the invention, the miniature pieces of chewing gum are miniature "tiny size" CHICLETS, which is a registered trademark of the Warner Lambert Co., Morris Plains, N.J.

Figure 2:
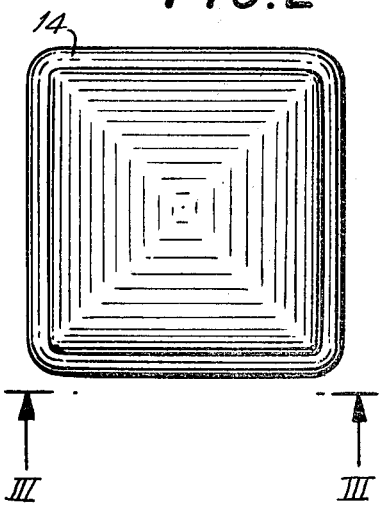
FIG. 2 is a top view of the cover of the embodiment of FIG. 1.
Figure 3:
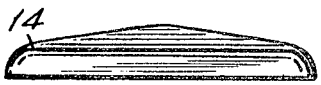
FIG. 3 is a view, taken along the lines III—III, of FIG. 2.

A cover 14 (FIGS. 1, 2 and 3) is removably mounted on the top 12 of the storage receptacle 11 for providing access to said receptacle. This enables an exhausted supply of miniature pieces of chewing gum, or the like, to be replenished, as desired.

The base member 1 has a guide slot 15 (FIGS. 10, 13, 15 and 16) formed in the top 3 thereof, as shown in FIG. 13, in spaced relation with the chute 4. The dispenser device 9 has a top 16 (FIGS. 8, 11, 12, 15, 16, 17 and 18) and a spaced bottom 17 (FIG. 17) with a guide pin 18 (FIGS. 17 and 18) extending downward from said bottom and slidably accommodated in the guide slot 15.

The base member 1 has a plurality of sides 19, 20, 21 and 22 (FIGS. 13, 15 and 16) extending between the top 3 and the bottom 2 thereof, substantially perpendicularly to said top and bottom. The base housing member 5 has a plurality of sides 23, 24, 25 and 26 (FIGS. 7 and 14) juxtaposed with the sides 19, 20, 21 and 22, respectively, of the base member 1.

The dispenser housing 8 of the base housing member 5 is of substantially conical configuration, as shown in FIGS. 1, 8, 9, 12 and 14, and has an axis 27 (FIG. 14), a solid apex portion 28 (FIGS. 1, 8 and 12) and a hollow base portion 29 (FIGS. 1, 7 and 8). Thus, the base portion 29 of the dispenser housing 8, next-adjacent the top 3 of the base member 1, is of substantially frusto-conical configuration, as shown in FIGS. 1 and 8.

The dispenser housing 8 has a notch 30 (FIGS. 1, 7, 8, 11, 12 and 14) extending substantially from the axis 27 of said dispenser housing in the solid apex portion 28 thereof. The notch 30 is of substantially V cross-section, with the vertex of said notch substantially coincident with the axis of the dispenser housing 8. The base housing member 5 has a ledge 31 (FIGS. 1, 7, 8, 9, 12 and 14) extending substantially perpendicularly from the top part 6 of said base housing member. The ledge 31 has a plurality of sides 32, 33, 34 and 35 (FIGS. 1, 7 and 14) corresponding to, and spaced from, the sides 23, 24, 25 and 26, respectively, of the base housing member 5. The bottom 13 of the storage receptacle 11 is juxtaposed with, and affixed to, the ledge 31. The bottom 13 of the receptacle 11 is fitted in the ledge 31 so that the outside surfaces of said bottom are in juxtaposition with, and affixed to, the inside surfaces of said ledge.

Figure 14:
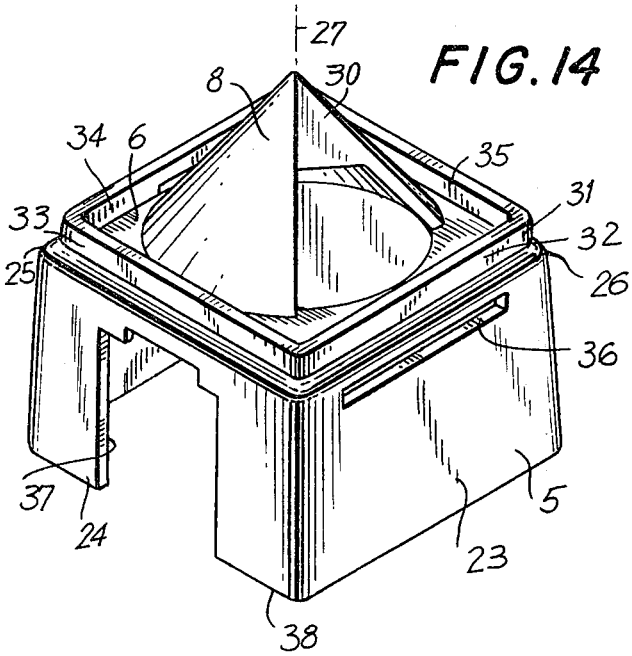
FIG. 14 is a perspective view of the base housing member of the embodiment of FIG. 1.

The side 23 of the base housing member 5 has a slot 36 (FIGS. 1, 8, 12 and 14) formed therethrough in proximity with, and substantially parallel to, the top part 6 of said base housing member. The side 24 of the base housing member 5 has an opening 37 therein, as shown in FIG. 14, extending from the bottom part 38 of said base housing member. The bottom part 38 of the base housing member 5 is spaced from the top part 6 thereof, as shown in FIG. 14. The arm 10 of the dispenser device 9 extends through the slot 36, as shown in FIGS. 1, 8 and 12, to facilitate manual movement of said device via said arm.

Figure 16:
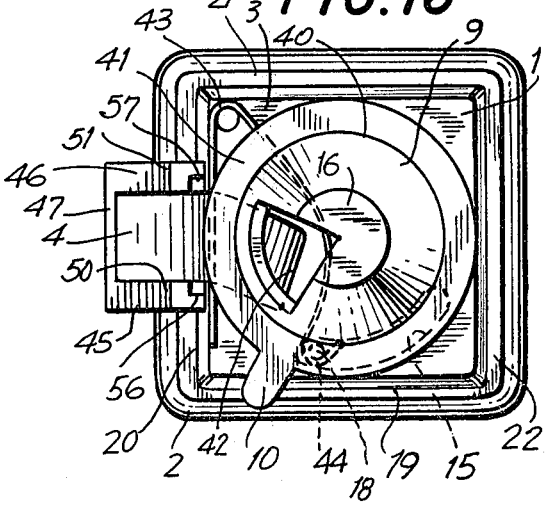
FIG. 16 is a top view of the dispenser device in position on the base member of the embodiment of FIG. 1, with the dispenser device in its second position, opposite the first.
Figure 17:
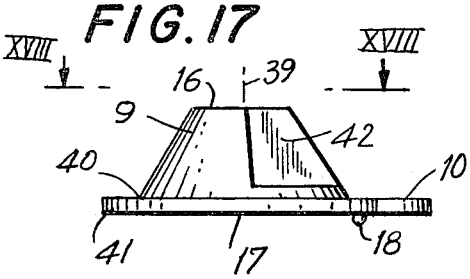
FIG. 17 is a side view of the dispenser device of the embodiment of FIG. 1.
Figure 18:
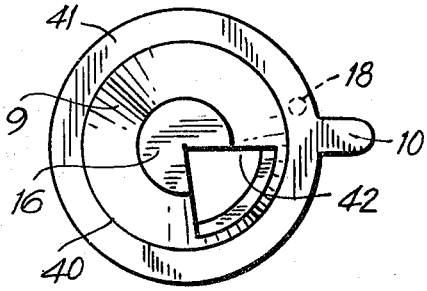
FIG. 18 is a view, taken along the lines XVIII—XVIII, of FIG. 17.

The dispenser device 9 is of substantially frusto-conical configuration, as shown in FIGS. 17 and 18, and is rotatably housed in the hollow base portion 29 of the dispenser housing 8 of the base housing member 5, as indicated in FIGS. 1, 8, 11 and 12. The dispenser device 9 has an axis 39 (FIG. 17) and a major base circumference 40 (FIGS. 15, 16, 17 and 18). A flange 41 extends substantially radially from the major base circumference 40, as shown in FIGS. 15, 16, 17 and 18. A notch 42 (FIGS. 1, 7, 8, 15, 16, 17 and 18) is formed in the dispenser device 9, extending substantially from the axis 39 thereof, as shown in FIGS. 17 and 18. The notch 42 of the dispenser device 9 is of substantially V cross-section, with the vertex of said notch substantially coincident with the axis 39 of said dispenser device, as shown in FIGS. 17 and 18.

Figure 15:
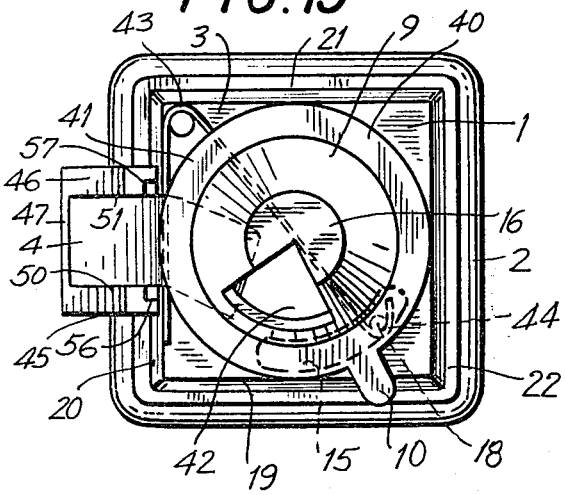
FIG. 15 is a top view of the dispenser device in position on the base member of the embodiment of FIG. 1, with the dispenser device in its first position.

When the dispenser device 9 is in a first position, shown in FIGS. 1, 7, 8 and 15, the notches 30 and 42 of said dispenser device and the dispenser housing 8, respectively, are substantially in alignment, so that a predetermined number of the miniature items are collected in the notch 42 of said dispenser device and supported by the top 3 of the base member 1 in spaced relation with the chute 4 (FIG. 15). Thus, the chute 4 is effectively blocked by the flange 41 of the dispenser device 9 and nothing is discharged from said chute. The miniature items, or miniature pieces of chewing gum, are not shown in the FIGS. in order to maintain the clarity of illustration.

When a child, or other operator of the machine, desires miniature items and manually rotates the dispenser device 9, via its arm 10, to a second position, shown in FIGS. 11, 12 and 16, the notches 30 and 42 of said dispenser device and the dispenser housing 8, respectively, are moved out of alignment, as shown in FIGS. 11, 12 and 16. The notch 42 of the dispenser device 9 is then in alignment with the chute 4, as shown in FIG. 16, so that the miniature items collected in said notch are moved by said dispenser device to said chute and deposited in said chute whence said items move down and are discharged from said chute. At such time, the dispenser device 9 blocks the opening 7 in the top part 6 of the base housing member 5, thereby preventing any miniature items, other then those transferred to the chute via the notch 42 of said dispenser device, from being discharged by the machine.

Figure 19:
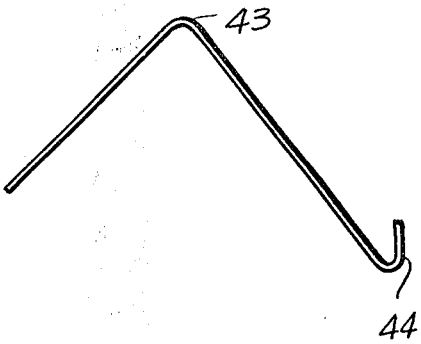
FIG. 19 is a view of an embodiment of a spring biasing member used with the embodiment of FIG. 1.

A spring biasing member 43, shown in FIG. 19, is provided between the top part 6 of the base housing member 5 and the top 3 of the base housing 1. The spring biasing member 43 is coupled to the dispenser device 9 and urges said dispenser device to its first position. The spring biasing member 43 preferably comprises a thin filament-type resilient member bent at slightly less than 90°, so that it fits in the area bounded by the ledge 31 and is held in position thereby. One end of the resilient member 43 has a hood 44 (FIG. 19) formed therein for coupling to the dispenser device 9.

The chute 4 of the base member 1 opens in the side 20, as shown in FIGS. 13, 15 and 16, from the top 3 to the bottom 2 thereof, as shown in FIG. 13, and in said top at said side, as shown in FIG. 13. The base member 1 has a pair of spaced substantially parallel walls 45 and 46 (FIGS. 1, 7, 9, 13, 15 and 16) extending from the side 20 of said base member, substantially perpendicularly to said side, at the sides of the chute 4. The walls 45 and 46 extend through the opening 37 of the side 24 of the base housing member 5, as shown in FIGS. 1, 9 and 14.

A lip 47 (FIGS. 1, 7, 8, 9, 10, 13, 15 and 16) extends substantially coplanarly with the bottom 2 of the base member 1 and beyond the side 20 thereof. The walls 45 and 46 join the lip 47 at spaced opposite sides of said lip, as shown in the FIGS.

The walls 45 and 46 have substantially coplanar edges 48 and 49, respectively, (FIGS. 1, 7, 9 and 13), spaced from the side 20 of the base member 1. The edges 48 and 49 have tops 50 and 51 (FIGS. 1, 9, 13, 15 and 16), respectively, spaced a predetermined distance D1 (FIG. 8) from the side 20, and bottoms 52 and 53 (FIGS. 1, 8 and 13), respectively, spaced a distance D2 (FIG. 8) from said side, greater than said predetermined distance.

The walls 45 and 46 have inside surfaces 54 and 55 (FIGS. 7 and 9), respectively, facing each other with a notch 56 and 57, respectively, formed in each of said inside surfaces at the top thereof, as shown in FIGS. 7, 9, 15 and 16. A chute flap 58 has spaced opposite sides 59 and 60, as shown in FIG. 1. A pair of pins 61 and 62 extend from the sides 59 and 60, respectively (FIG. 1), and are accommodated in the notches 56 and 57, respectively. The chute flap 58 thus hangs over the chute 4 in the side 20 of the base member 1 and is pivotally moved to open said chute by miniature items sliding out of said chute.

While the invention has been described by means of a specific example and in a specific embodiment, I do not wish to be limited thereto, for obvious modifications will occur to those skilled in the art without departing from the spirit and scope of the invention.

I claim:

1. A miniature item machine, comprising a base member having a bottom, a top spaced therefrom and a chute formed therein and extending from the top to the bottom thereof;

a base housing member fitted on said base member and having a top part spaced from the top of said base member, said top part having an opening formed therein partially extending over said chute and a dispenser housing of substantially conical configuration extending upward therefrom around part of said opening, said dispenser housing having an axis, a solid apex portion and a hollow base portion whereby said base portion next-adjacent the top of said base member is of substantially frusto-conical configuration;

a dispenser device rotatably mounted in the dispenser housing of said base housing member on the top of said base member and having an arm extending from said base housing member for selectively manually rotating said dispenser device;

a storage receptacle of substantially sleeve-like configuration having an open top and a spaced open bottom affixed to the top part of said base housing member for storing miniature items whereby a predetermined number of said items are selectively dispensed from said storage receptacle to said chute and thence out of said chute by manual rotation of said dispenser device; and a cover removably mounted on the top of said storage receptacle for providing access to said receptacle.

2. A miniature item machine as claimed in claim 1, wherein said base member has a plurality of sides extending between the top and bottom thereof substantially perpendicularly thereto, and said base housing member has a plurality of sides juxtaposed with the sides of said base member.

3. A miniature item machine as claimed in claim 2, wherein said base housing member has a ledge extending substantially perpendicularly from the top part thereof and having a plurality of sides corresponding to and spaced from the sides of said base housing member, said bottom of said storage receptacle being juxtaposed with and affixed to said ledge.

4. A miniature item machine, comprising a base member having a bottom, a top spaced therefrom, a plurality of sides extending between the top and bottom substantially perpendicular thereto and a chute formed therein and extending from the top to the bottom thereof;

a base housing member fitted on said base member and having a plurality of sides juxtaposed with the sides of said base member and a top part spaced from the top of said base member, said top part having an opening formed therein partially extending over said chute and a dispenser housing of substantially conical configuration extending upward therefrom around part of said opening, said dispenser housing having an axis, a solid apex portion and a hollow base portion whereby said base portion next-adjacent the top of said base member is of substantially frusto-conical configuration, said dispenser housing having a notch formed therein extending substantialy from the axis thereof in the solid apex portion thereof, said notch being of substantially V cross-section with the vertex of said notch substantially coincident with the axis of said dispenser housing;

a dispenser device rotatably mounted in the dispenser housing of said base housing member on the top of said base member and having an arm extending from said base housing member for selectively manually rotating said dispenser device;

a storage receptacle of substantially sleeve-like configuration having an open top and a spaced open bottom affixed to the top part of said base housing member for storing miniature items whereby a predetermined number of said items are selectively dispensed from said storage receptacle of said chute and thence out of said chute by manual rotation of said dispenser device; and a cover removably mounted on the top of said storage receptacle for providing access to said receptacle.

5. A miniature item machine as claimed in claim 4, wherein said dispenser device is of substantially frusto-conical configuration and is rotatably housed in the hollow base portion of said dispenser housing of said base housing member, said dispenser device having an axis, a major base circumference, a flange extending substantially radially from said major base circumference and a notch formed therein extending substantially from the axis thereof, said notch being of substantially V cross-section with the vertex of said notch substantially coincident with the axis of said dispenser device, said arm of said dispenser device extending substantially radially from and substantially coplanarly with said flange whereby when said dispenser device is in a first position the notches of said dispenser device and said dispenser housing are substantially in alignment so that said miniature items are collected in said notch of said dispenser device and supported by said top of said base member in spaced relation with said chute and when said dispenser device is manually rotated via the arm thereof to a second position the notches of said dispenser device and said dispenser housing are moved out of alignment and said notch of said dispenser device is in alignment with said chute so that said miniature items collected in said notch of said dispenser device are moved by said dispenser device to said chute and deposited in said chute whence said items move down and out of said chute.

6. A miniature item machine as claimed in claim 5, further comprising spring biasing means between the top part of said base housing member and the top of said base housing, said spring biasing means being coupled to said dispenser device and urging said dispenser device to said first position thereof.

7. A miniature item machine, comprising a base member having a bottom, a top spaced therefrom, a plurality of sides extending between the top and bottom substantially perpendicular thereto and a chute formed therein and extending from the top to the bottom thereof, said chute of said base member opening in one of the sides thereof from the top to the bottom thereof and in the top thereof at said one of said sides, and said base member having a pair of spaced substantially parallel walls extending from said one of said sides thereof substantially perpendicularly to said one of said sides at the sides of said chute and a lip extending substantially coplanarly with the bottom of said base member and beyond said one of said sides, said walls joining said lip at spaced opposite sides of said lip;

a base housing member fitted on said base member and having a plurality of sides juxtaposed with the sides of said base member, a top part spaced from the top of said base member, said top part having an opening formed therein partially extending over said chute and a dispenser housing of substantially conical configuration extending upward therefrom around part of said opening, said dispenser housing having an axis, a solid apex portion and a hollow base portion whereby said base portion next-adjacent the top of said base member is of substantially frusto-conical configuration, and a bottom part spaced from the top part thereof and wherein one of the sides of said base housing member has a slot formed therethrough in proximity with and substantially parallel to the top part thereof and another of the sides of said base housing member has an opening therein extending from the bottom part thereof, said pair of walls of said base member extending through the opening of said other of said sides of said base housing member;

a dispenser device rotatably mounted in the dispenser housing of said base housing member on the top of said base member and having an arm extending from said base housing member for selectively manually rotating said dispenser device, said arm extending through said slot through said one of said sides of said base housing member to facilitate manual movement thereof;

a storage receptacle of substantially sleeve-like configuration having an open top and a spaced open bottom affixed to the top part of said base housing member for storing miniature items whereby a predetermined number of said items are selectively dispensed from said storage receptacle to said chute and thence out of said chute by manual rotation of said dispenser device; and a cover removably mounted on the top of said storage receptacle for providing access to said receptacle.

8. A miniature item machine as claimed in claim 7, wherein said walls have substantially coplanar edges spaced from said one of said sides of said base member and said edges have tops spaced a predetermined distance from said one of said sides and bottoms spaced a distance from said one of said sides greater than said predetermined distance.

9. A miniature item machine as claimed in claim 8, wherein said walls have inside surfaces facing each other with a notch formed on each of said inside surfaces at the top thereof, and further comprising a chute flap having spaced opposite sides and a pair of pins extending from said sides and pivotally accommodated in said notches whereby said chute flap hangs over said chute in said one of said sides and is pivotally moved to open said chute by miniature items sliding out of said chute.

* * * * *